United States Patent [19]

Singer

[11] Patent Number: 4,556,178

[45] Date of Patent: Dec. 3, 1985

[54] HOLDER FOR YARN PACKAGE

[75] Inventor: Hans S. Singer, Greenville, S.C.

[73] Assignee: Hans S. Singer Co., Inc., Greenville, S.C.

[21] Appl. No.: 619,385

[22] Filed: Jun. 11, 1984

[51] Int. Cl.[4] ..... B65H 49/02; D03J 5/08

[52] U.S. Cl. ..... 242/130; 248/240.4

[58] Field of Search ..... 242/129.5, 129.7, 130, 242/130.1, 130.2, 131, 131.1, 46.3; 279/2 R, 1 DC, 1 DA; 211/4; 24/137 R, 262; 269/47, 48; 248/240.4

[56] References Cited

U.S. PATENT DOCUMENTS

| | | | |
|---|---|---|---|
| 499,667 | 6/1893 | Foster | 242/130.1 |
| 1,887,790 | 11/1932 | Stogner | 242/46.3 |
| 3,850,394 | 11/1974 | Raasch et al. | 242/129.7 |
| 3,897,915 | 8/1975 | Budzyna | 242/130.1 |
| 4,399,957 | 8/1983 | Singer | 242/130 |

*Primary Examiner*—Leonard D. Christian

*Attorney, Agent, or Firm*—Bailey & Hardaway

[57] ABSTRACT

A holder for a yarn package having a yarn carrier wherein a lip is confined between wedging members and supported by an outwardly extending bracket member and a mounting plate.

3 Claims, 3 Drawing Figures

Fig. 2
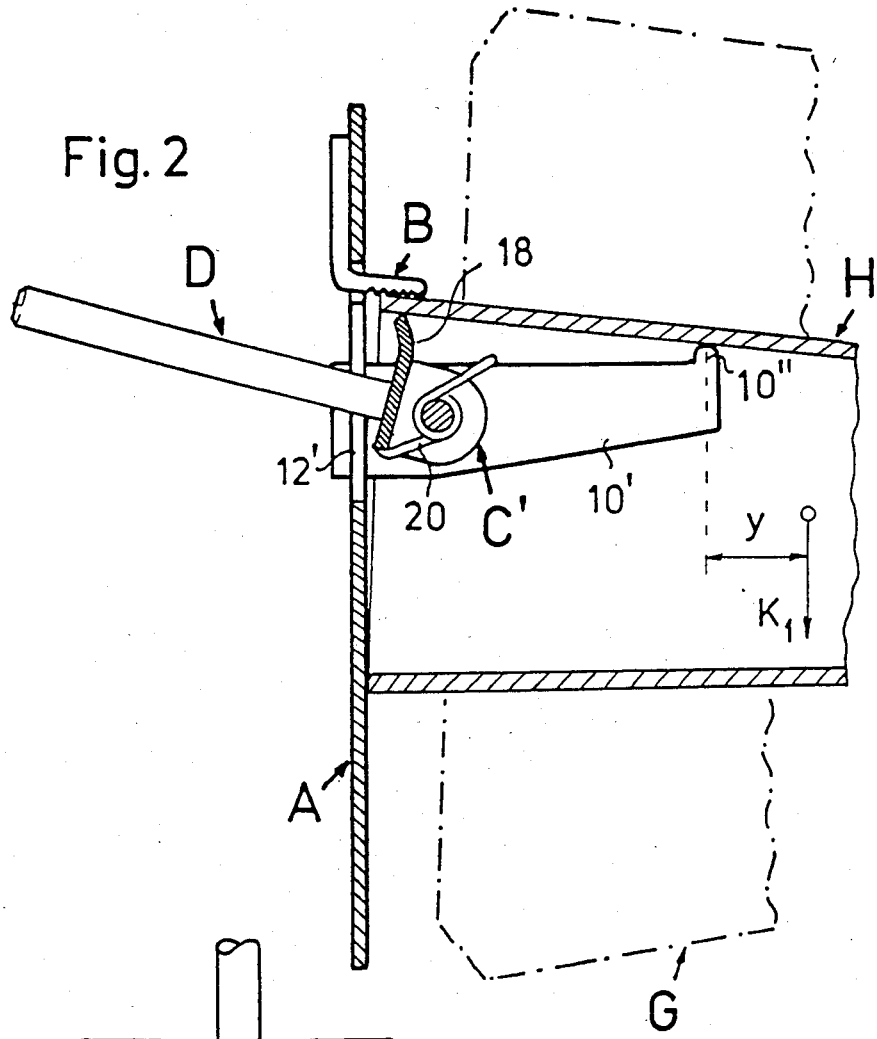
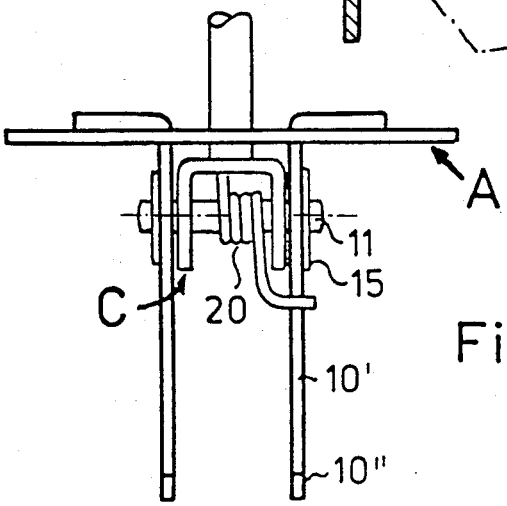
Fig. 3

HOLDER FOR YARN PACKAGE

BACKGROUND OF THE INVENTION

The invention relates to a holder for a yarn package including a yarn carrier with a circular extended lip. Such yarn carriers consist primarily of cardboard or plastic with different diameters and being of cylindrical or conical form. The fully wound yarn package also has a cylindrical or conical shape.

In the textile industry a number of these yarn packages are held by a creel and the yarn is pulled from these packages to a production machine. Such creels are used for looms, knitting machines, warpers, tufting machines and others. On the presently known creels the yarn packages are placed on a relatively long pin. To save space, pins are placed as close as possible making placing of yarn packages on pins difficult. For this reason, provision is made for the pins to swing out for placing the yarn package and such are often not returned to proper alignment of the yarn guide increasing the yarn tension of yarn pulled from yarn package.

Other suggestions according to U.S. Pat. No. 3,850,394 and U.S. Pat. No. 3,951,353 disclose solutions wherein the yarn carrier is wedged from the inside. According to size of diameter and shape of yarn carrier, namely cylindrical or conical, different adaptors are used.

An object of this invention is to have a universal package holder, with minimum extention holding cylindrical and conical yarn carriers of different diameter. With this invention, the removal of empty yarn packages and placing full yarn packages is simplified and time is saved.

This is an improvement upon U.S. Pat. No. 4,399,957 which discloses a holder for positioning a yarn package securely on a creel by wedging the lip of the yarn carrier.

For large and heavy yarn packages, an additional holding point for the yarn carrier is important as described below.

SUMMARY OF THE INVENTION

A yarn package holder is provided to carry a yarn carrier wound with yarn on a creel wherein the yarn carrier is wedged at one place. The yarn package holder includes a mounting plate with a fixedly connected wedging member and a movable wedging member. The wedging member has an upwardly outwardly extending wedging part 18 and a releasing lever. A spring has the tendency to rotate a wedging member clockwise. By inserting yarn carrier between the wedging members, the extended lip of yarn carrier is solidly wedged. The weight of the yarn package increases the wedging action. The yarn carrier is released by rotating wedging member counter clockwise. In accordance with the invention, the inside wall of yarn carrier rests on extended mounting brackets to hold heavy yarn packages. Such package holders are used on a creel to hold many yarn packages feeding textile machines.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 2 is a side elevation illustrating a package holder constructed in accordance with the present invention, and FIG. 3 is a top plan view of the package holder illustrated in FIG. 2.

DESCRIPTION OF A PREFERRED EMBODIMENT

Figure 1:
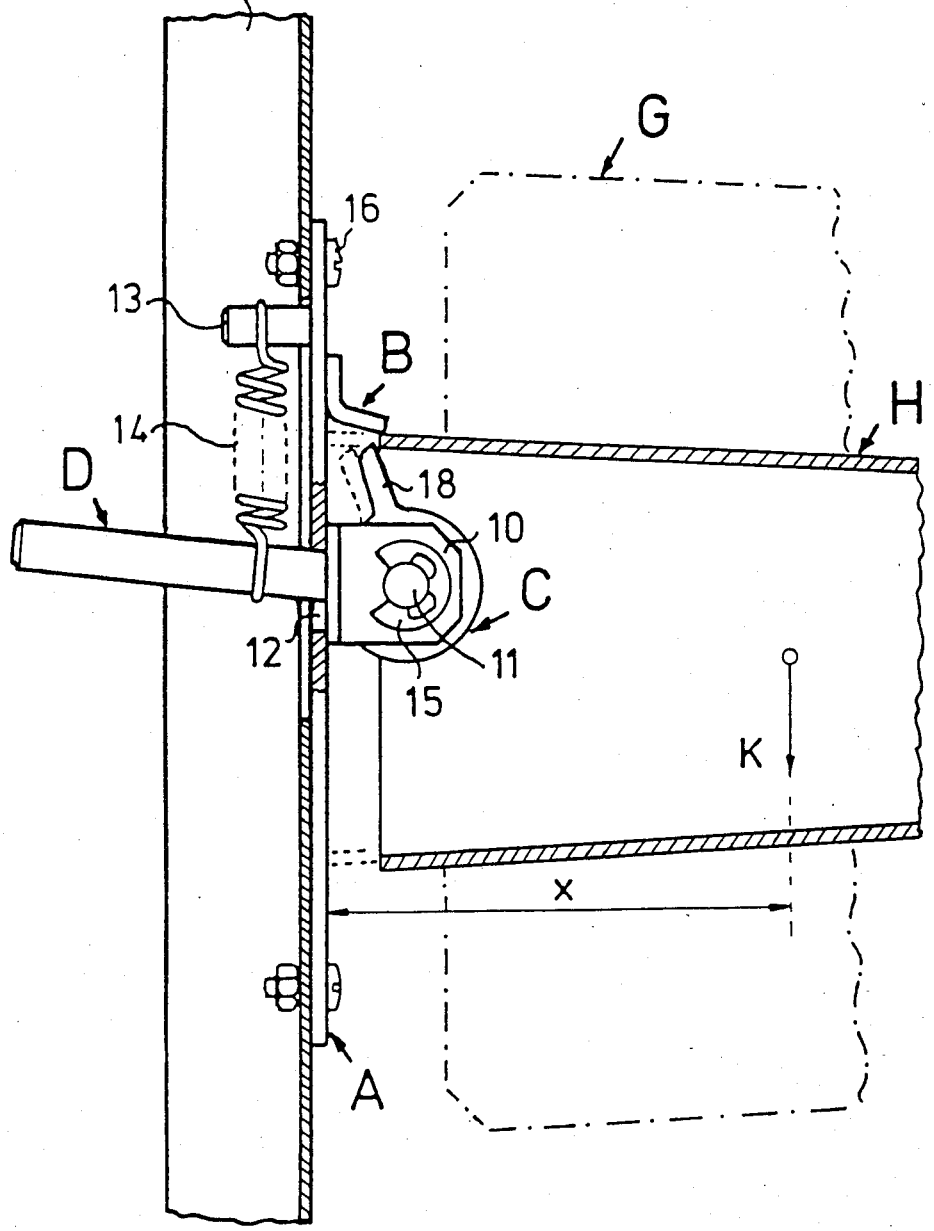
FIG. 1 is a side elevation illustrating a prior art package holder, of which the present invention is an improvement.

The main parts of the package holder (FIG. 1) include the mounting plate A with a forwardly extending fixedly connected wedging member B and a second displacable wedging member C carried by the mounting plate A.

The wedging member C is carried between two L shaped mounting brackets 10 connected to the mounting plate A and rotates on pin 11.

The rotating wedging member C consists of a wedging part 18 and a releasing lever D extending behind mounting plate A through slot 12.

Behind the mounting plate A, above the releasing lever D is stud 13. Between the stud 13 and the releasing lever D is a wedging member C actuated by a spring to turn clockwise.

The upper end of slot 12 creates a stop for releasing the lever D and the wedging part 18.

The pin 11 is secured by two rings 15 outside of L shaped mounting parts 10.

The extended part of wedging member B points slightly downwardly. The wedging part 18 of wedging member C points slightly towards mounting plate A when in resting position without touching wedging member B.

By pushing yarn carrier H of yarn package G horizontally between the wedging member B and the wedging member C towards mounting place A, the wedging part 18 is activated to turn counter clockwise. Spring 14 wedges the lip of the yarn carrier H between wedging member B with wedging part 18 of wedging member C and holds the yarn package G firm to creel.

Since center of pin 11 extends further out than the wedging point, the weight of yarn package G increases wedging action.

FIG. 1 shows yarn carrier H when inserted into the package holder. The dotted lines show full inserted position.

The yarn wound on yarn carrier H shows the full yarn package with broken lines.

With this yarn package holder, the upper part of yarn carrier H is held with wedging member B and C and the lower part of yarn carrier H is held by the mounting plate A. The weight of the yarn package creates a tilting action ($K \times X$) and increases the previous described increase of the wedging action.

With large and heavy yarn packages the extended lip of yarn carrier H can still be torn off and package falls off the package holder.

FIGS. 2 and 3 show an improved yarn package holder capable of holding large and very heavy yarn packages. This is done by extending the mounting brackets 10' for the wedging member C positioning the end of the mounting brackets 10'' further away from mounting plate A.

The yarn carrier H is inserted the same way between wedging members B and C but also is supported by the extended mounting brackets 10''. This reduces the tilting action of the yarn package ($K_1 \times Y$) and the pulling action on wedging members is considerably reduced.

In FIGS. 2 and 3 are parts having the same function as in FIG. 1. The extended mounting brackets 10' are fixedly connected to the mounting plate A and extend through slots 12 to opposite part of mounting plate A. The very front of mounting brackets 10' has an elevated supporting projection 10''.

The wedging member C is U shaped with an upwardly and inwardly extending wedging part 18.

Instead of a tension spring such as illustrated at 14, a torsion spring 20 is provided. For additional gripping of the yarn packages, the lower part of wedging member B is serrated.

If, as described above, a yarn package is inserted into the package holder, the upper lip of the yarn carrier is wedged by wedging member B and C. The inside wall of yarn carrier H rests in addition on the extended mounting brackets 10'' which reduces the tilting action of the yarn package ($K_1 \times Y$). This results in a considerable reduction of pulling due to the weight of yarn package ($K_1$).

While a preferred embodiment of the invention has been described using specific terms, such description is for illustrative purposes only and it is to be understood that changes and variations may be made without departing from the spirit or scope of the following claims.

What is claimed is:

1. A yarn package holder for carrying a yarn package having a yarn carrier with at least one outwardly extended annular lip including:

a mounting plate;

an outwardly extending wedging member finally carried by said plate;

a rotatable spring loaded wedging member opposite said first mentioned wedging member;

mounting brackets fixed to said mounting plate carrying said spring loaded wedging member enabling the insertion of a yarn package so that the lip of the yarn carrier is wedged between said wedging members; and an outwardly extended portion of said mounting brackets providing an additional support for the yarn carrier.

2. The structure set forth in claim 1 wherein said mounting plate projects downwardly beneath said brackets and said wedging members for supporting a portion of the lip of the yarn carrier opposite the wedging members.

3. The structure set forth in claim 1 wherein the fixedly connected wedging member is serrated on a side facing the movable wedging member.

* * * * *